US005420375A

United States Patent [19]

Folkins et al.

[11] Patent Number: 5,420,375

[45] Date of Patent: May 30, 1995

[54] PROPER CHARGING OF DONOR ROLL IN HYBRID DEVELOPMENT

[75] Inventors: Jeffrey J. Folkins, Rochester; Thomas J. Behe, Webster; Joseph G. Schram, Liverpool, all of N.Y.

[73] Assignee: Xerox Corporation, Stamford, Conn.

[21] Appl. No.: 245,108

[22] Filed: May 17, 1994

Related U.S. Application Data

[63] Continuation of Ser. No. 986,312, Dec. 7, 1992, Pat. No. 5,341,197.

[51] Int. Cl.[6] ..... G03G 15/06

[52] U.S. Cl. ..... 118/652; 355/264; 118/659

[58] Field of Search ..... 355/245, 251, 253, 261, 355/259, 264, 265, 269, 270, 305; 118/653, 657, 658, 652; 430/103, 120, 122

[56] References Cited

U.S. PATENT DOCUMENTS

| | | | |
|---|---|---|---|
| 4,480,911 | 11/1984 | Itaya et al. | 355/259 X |
| 4,615,606 | 10/1986 | Nishikawa | 355/251 |
| 4,868,600 | 9/1989 | Hays et al. | 355/259 |
| 5,341,197 | 8/1994 | Folkins et al. | 355/264 |

FOREIGN PATENT DOCUMENTS

| | | | |
|---|---|---|---|
| 58-137862 | 8/1983 | Japan | 355/270 |
| 60-50551 | 3/1985 | Japan | 355/270 |

*Primary Examiner*—Benjamin R. Fuller
*Assistant Examiner*—John E. Barlow, Jr.
*Attorney, Agent, or Firm*—T. L. Fair

[57] ABSTRACT

A method and apparatus involving the stopping and starting of the development of images, using hybrid development, to insure proper charging of the donor toner layer. A second (e.g. magnetic brush) roll is used to place toner on the donor roll or remove toner from the donor roll depending upon whether the development of images is stopped or started.

11 Claims, 3 Drawing Sheets

$V_{dm} = V_{donor} - V_{mg}$

PROPER CHARGING OF DONOR ROLL IN HYBRID DEVELOPMENT

This is a continuation of application Ser. No. 07,986,312, filed Dec. 7, 1992, now U.S. Pat. No. 5,341,197.

BACKGROUND OF THE INVENTION

This invention relates generally to an ionographic or electrophotographic printing machine, and more particularly concerns using a magnetic roll to apply and remove toner from the donor roll to achieve the desired charge of the donor roll.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. Toner particles are attracted to the latent image forming a toner powder image on the photoconductive surface. The toner powder image is subsequently transferred to a copy sheet. Finally, the toner powder image is heated to permanently fuse it to the copy sheet in image configuration.

Single component development systems use a donor roll for transporting charged toner to the development nip defined by the donor roll and photoconductive member. The toner is developed on the latent image recorded on the photoconductive member by a combination of mechanical and/or electrical forces. Two component development systems have been used extensively in many different types of printing machines. A two component development system usually employs a magnetic brush developer roller for transporting carrier having toner adhering triboelectrically thereto. Two component development systems and single component development systems each have their own advantages. Accordingly, it is desirable to combine these systems to form a hybrid development system having the desirable features of each system. However, in combining these two systems, when a magnetic brush roll and a donor roll are used, proper charging of the donor roll with a toner layer is needed.

An apparatus for developing an electrostatic latent image in which developer material is transferred from a chamber to the donor roll for developing an electrostatic latent image is disclosed in a U.S. Pat. No. 5,063,875, issued Nov. 12, 1991 to J. J. Folkins. The present invention represents a development n the above-cited technology and accordingly this reference is incorporated by reference in the present specification.

The following disclosures may be relevant to various aspects of the present invention and may be briefly summarized as follows:

U.S. Pat. No. 3,929,028 to Liebman describes a developer sump located below a donor roll. A developer mix of toner particles and ferromagnetic carrier granules is in the sump. A cylinder having a magnet disposed therein rotates through the developer mix and conveys the developer mix adjacent the donor roll. An electrical field between the cylinder and donor roll loads the donor roll with toner particles.

U.S. Pat. No. 4,868,600 to Hayes et al. describes a scavengeless development system in which a donor roll has toner deposited thereon. A pair of electrode wires are closely spaced to the donor roll in the gap between the donor roll and the photoconductive member. An AC voltage is applied to the electrode wires to detach toner from the donor roll and form a toner powder cloud in the gap. Toner from the toner powder cloud is attracted to the latent image recorded on the photoconductive member to develop the latent image recorded thereon. A conventional magnetic brush used with two component developer could be used for depositing the toner layer onto the donor roll.

SUMMARY OF INVENTION

Briefly stated, and in accordance with one aspect of the present invention, there is provided a method for charging toner on a donor roll to a desired magnitude in a printing machine comprising the following steps. Stopping the development of images. Changing the magnitude of the differential electrical bias being applied between the donor roll and a second roll. And, removing the toner from the donor roll to clean the donor roll.

Pursuant to another aspect of the present invention, there is provided an apparatus for developing a latent image with toner comprising a means for transporting toner adjacent to the latent image. Means for supplying toner to the transporting means. And, means for forming a voltage difference between the supplying means and the transporting means with the voltage difference being of a first magnitude to attract toner from the supplying means to the transporting means and of a second magnitude, different from the first magnitude, to attract toner from the transporting means to the supplying means.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same.

Inasmuch as the art of electrophotographic printing is well known, the various processing stations employed in the FIG. 1 printing machine will be shown hereinafter schematically and their operation described briefly with reference thereto.

Figure 3:
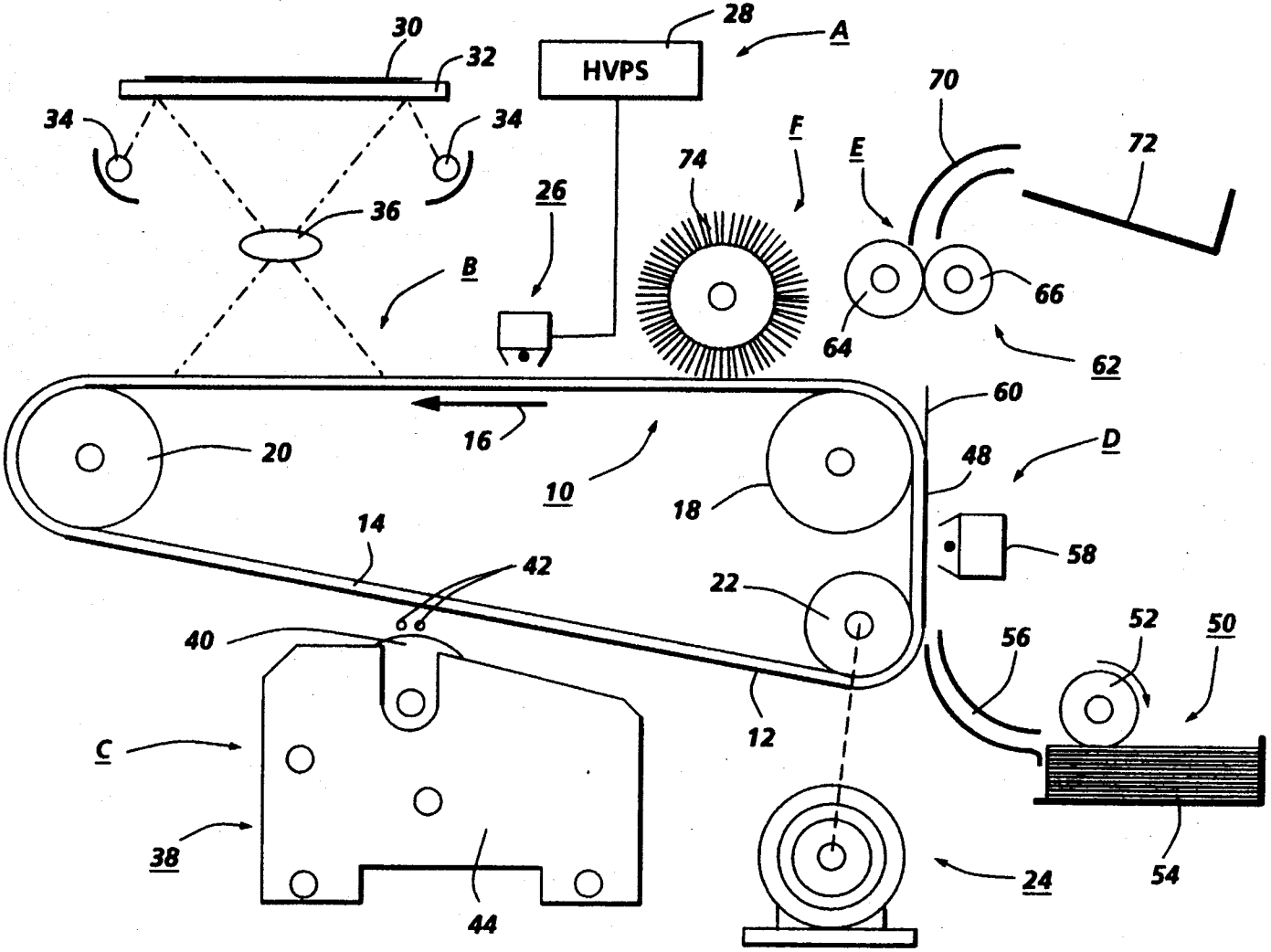
FIG. 3 is a schematic elevational view of an illustrative electrophotographic printing machine incorporating a development apparatus having the features of the present invention therein.

Referring initially to FIG. 3, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a development system, indicated generally by the reference numeral 38, develops the latent image recorded on the photoconductive surface. Preferably, development system 38 includes donor roller 40 and electrode wires 42. Electrode wires 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor rollers 40 is mounted, at least partially, in the chamber of developer housing 44. The chamber in developer housing 44 stores a supply of developer material. The developer material is a two component developer material of at least carrier granules having toner particles adhering triboelectrically thereto. A magnetic roller disposed interiorly of the chamber of housing 44 conveys the developer material to the donor roller. The magnetic roller is electrically biased relative to the donor roller so that the toner particles are attracted from the magnetic roller to the donor roller. The development apparatus will be discussed hereinafter, in greater detail, with reference to FIG. 1 and 2.

With continued reference to FIG. 3, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 60 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
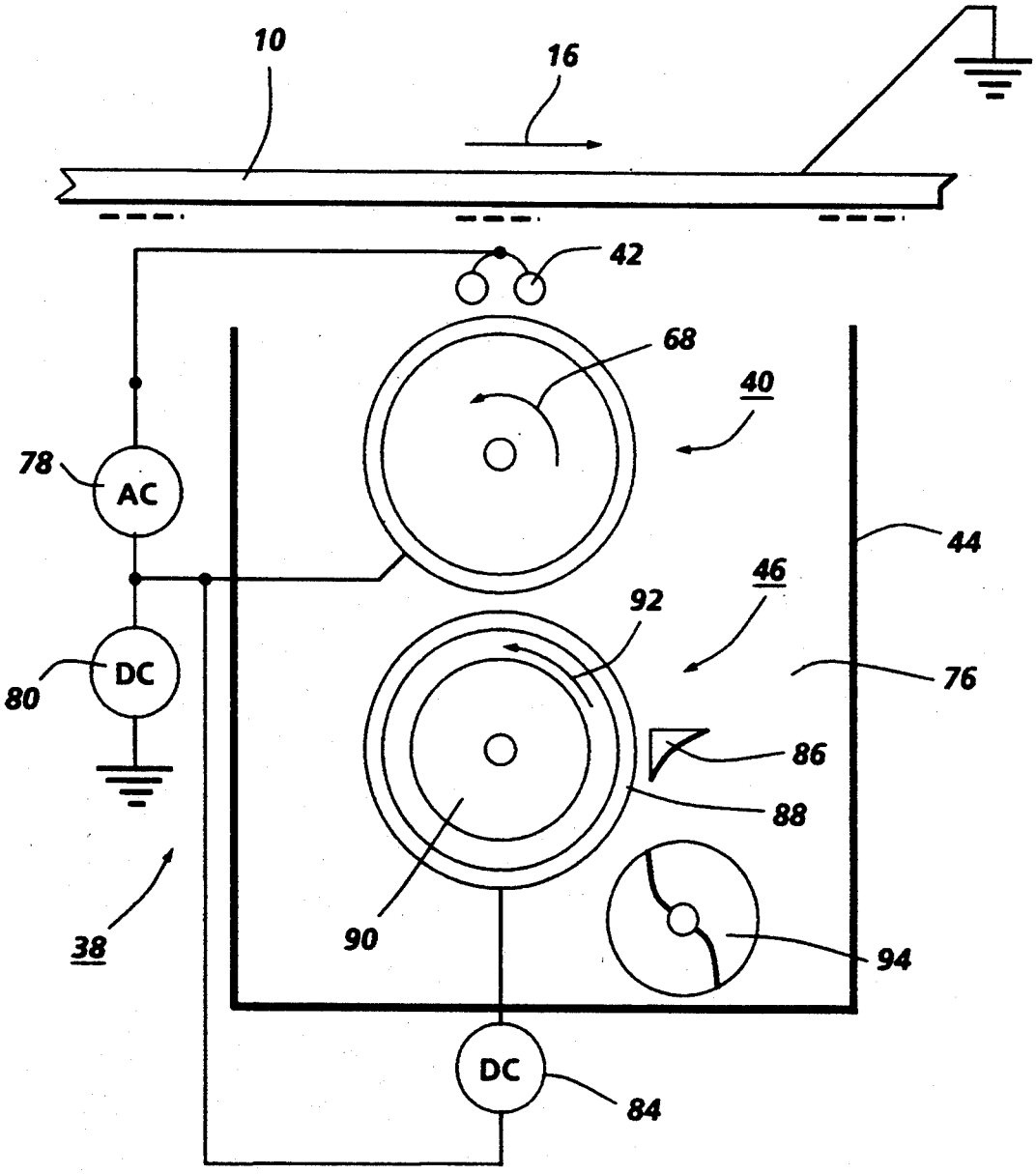
FIG. 1 is a schematic elevational view showing the development apparatus used in the FIG. 3 printing machine.

Referring now to FIG. 1, there is shown development system 38 in greater detail. [More specifically a hybrid development system is shown where toner is loaded onto a donor roll from a second roll (e.g. a magnetic brush roll). The toner is developed onto the photoreceptor from the donor roll using one of many techniques which include: wire scavengeless, embedded wire scavengeless, AC jumping, DC jumping, and contact.] As shown thereat, development system 38 includes a housing 44 defining a chamber 76 for storing a supply of developer material therein. Donor roller 40, electrode wires 42 and magnetic roller 46 are mounted in chamber 76 of housing 44. The donor roller can be rotated in either the 'with' or 'against' direction relative to the direction of motion of the donor roller 40. In FIG. 1, donor roller 40 is shown rotating in the direction of arrow 68, i.e. the against direction. Similarly, the magnetic roller 46 can be rotated in either the 'with' or 'against' direction relative to the direction of motion of donor roller 40. In FIG. 1, magnetic roller 46 is shown rotating in the direction of arrow 92 i.e. the against direction. Donor roller 40 is preferably made from anodized aluminum. Development system 38 also has electrode wires 42 which are disposed in the space between the belt 10 and donor roller 40. A pair of electrode wires are shown extending in a direction substantially parallel to the longitudinal axis of the donor roller. The electrode wires are made from one or more thin (i.e. 50 to 100μ diameter) wires (e.g. made of stainless steel or tungsten) which are closely spaced from donor roller 40. The distance between the wires and the donor roller is approximately 25μ or the thickness of the toner layer on the donor roll. The wires are self-spaced from the donor roller by the thickness of the toner on the donor roller. To this end the extremities of the wires supported by the tops of end bearing blocks also support the donor roller for rotation. The wire extremities are attached so that they are slightly below a tangent to the surface, including toner layer, of the donor structure. Mounting the wires in such a manner makes them insensitive to roll runout due to their self-spacing.

With continued reference to FIG. 1, an alternating electrical bias is applied to the electrode wires by an AC voltage source 78. The applied AC establishes an alternating electrostatic field between the wires and the donor roller which is effective in detaching toner from the surface of the donor roller and forming a toner cloud about the wires, the height of the cloud being such as not to be substantially in contact with the belt 10. The magnitude of the AC voltage is on the order of 200 to 500 volts peak at a frequency ranging from about 3 kHz to about 10 kHz. A DC bias supply 80 which applies approximately 300 volts to donor roller 40 establishes an electrostatic field between photoconductive surface 12 of belt 10 and donor roller 40 for attracting the detached toner particles from the cloud surrounding the wires to the latent image recorded on the photoconductive surface. At a spacing ranging from about 10μ to about 40μ between the electrode wires and donor roller, an applied voltage of 200 to 500 volts produces a relatively large electrostatic field without risk of air breakdown. The use of a dielectric coating on either the electrode wires or donor roller helps to prevent shorting of the applied AC voltage. Magnetic roller 46 meters a constant quantity of toner having a substantially constant charge onto donor roller 40. This insures that the donor roller provides a constant amount of toner having a substantially constant charge in the development gap. However, rather than using a cleaning blade, the preferred embodiment for the present invention is the combination of donor roller spacing, i.e. spacing between the donor roller and the magnetic roller, the compressed pile height of the developer material on the magnetic roller, and the magnetic properties of the magnetic roller in conjunction with the use of a conductive, magnetic developer material achieves the deposition of a constant quantity of toner having a substantially constant charge on the donor roller. A DC bias supply 84 which applies approximately 100 volts to magnetic roller 46 establishes an electrostatic field between magnetic roller 46 and donor roller 40 so that an electrostatic field is established between the donor roller and the magnetic roller which causes toner particles to be attracted from the magnetic roller to the donor roller. Metering blade 86 is positioned closely adjacent to magnetic roller 46 to maintain the compressed pile height of the developer material on magnetic roller 46 at the desired level. Magnetic roller 46 includes a non-magnetic tubular member 88 made preferably from aluminum and having the exterior circumferential surface thereof roughened. An elongated magnet 90 is positioned interiorly of and spaced from the tubular member. The magnet is mounted stationarily. The tubular member rotates in the direction of arrow 92 to advance the developer material adhering thereto into the nip defined by donor roller 40 and magnetic roller 46. Toner particles are attracted from the carrier granules on the magnetic roller to the donor roller.

With continued reference to FIG. 1, augers, indicated generally by the reference numeral 94, are located in chamber 76 of housing 44. Augers 94 are mounted rotatably in chamber 76 to mix and transport developer material. The augers have blades extending spirally outwardly from a shaft. The blades are designed to advance the developer material in the axial direction substantially parallel to the longitudinal axis of the shaft.

As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized. In this way, a substantially constant amount of toner particles are in the chamber of the developer housing with the toner particles having a constant charge. The developer material in the chamber of the developer housing is magnetic and may be electrically conductive. By way of example, the carrier granules include a ferromagnetic core having a thin layer of magnetite overcoated with a non-continuous layer of resinous material. The toner particles are made from a resinous material, such as a vinyl polymer, mixed with a coloring material, such as chromogen black. The developer material comprise from about94% to about 99% by weight of carrier and from 6% to about 1% by weight of toner. However, one skilled in the art will recognize that any suitable developer material having at least carrier granules and toner particles may be used.

With continued reference to FIG. 1, some of the difficulties with a hybrid magnetic brush loaded donor roll developer when using a constant loading voltage $V_{dm}=V_{donor\ DC\ bias}-V_{magnetic\ brush\ DC\ bias}$ (i.e. Thus, $V_{dm}$ is voltage 84 in FIG. 1.) are: 1) the constant running of the magnetic brush against the donor roll builds up fine toner particles on the donor roll which eventually interfere with development; 2) when the machine is off, the toner left on the donor roll presents a dirt source; 3) when the machine is in the process of turning on or off the presence of toner on the donor roll, coupled with uncontrolled voltages at the photoconductor and/or on the developer housing, the opportunity for unwanted toner development to the photoconductor is provided; and 4) if toner is left on the donor roll during long wait periods between copies (e.g. over night) there is a large probability of a loss of charge of this toner on the donor roll. This charge loss will cause development defects during the next development operation. The present invention provides for a means of stripping the toner from the donor roll at selected times and then resupplying new "fresh" toner before operation, thus solving or significantly reducing the above identified difficulties.

Figure 2:
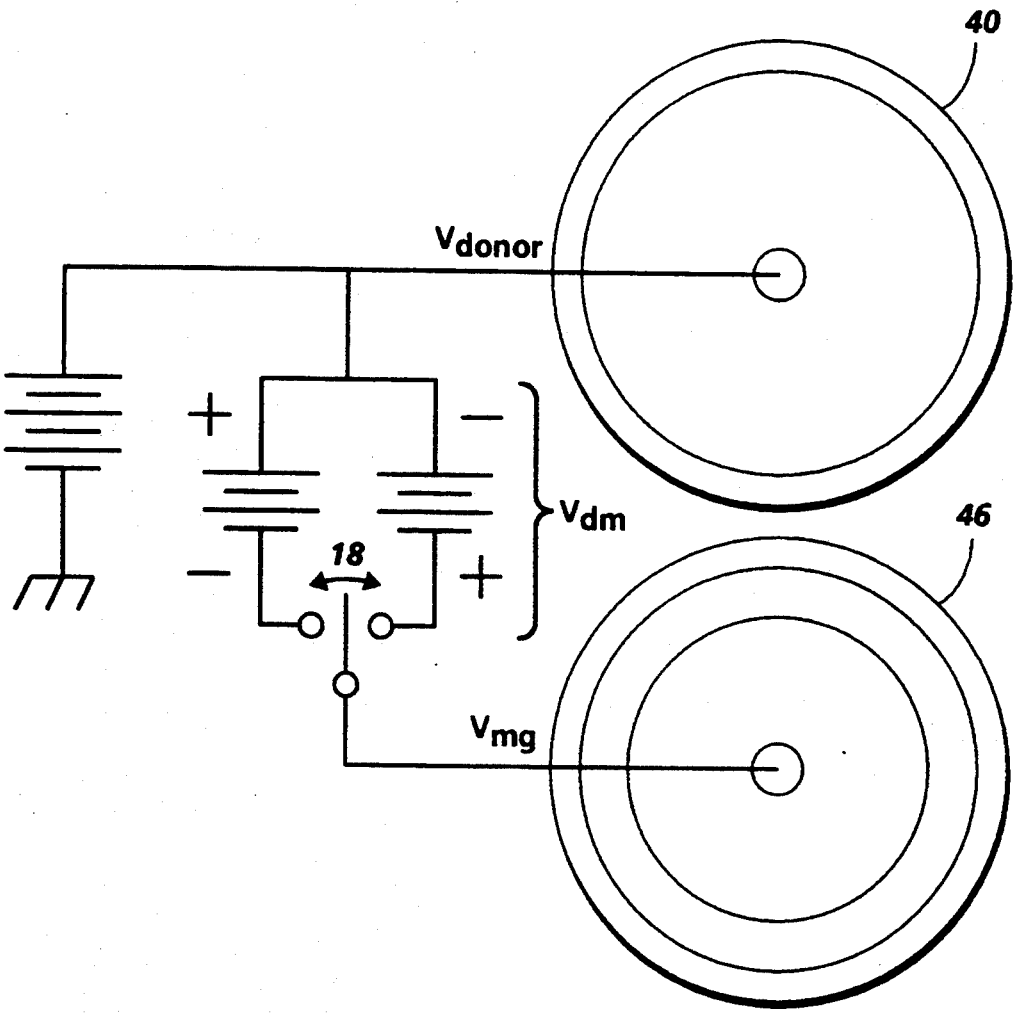
FIG. 2 is a schematic of an electrical arrangement for the switching of the voltage difference between the donor roll and the magnetic brush roll.

Referring now to FIG. 2, which illustrates the preferred embodiment of the electrical arrangement for switching $V_{dm}$, the voltage difference between the donor roll 40 and the magnetic brush roll 46. The $V_{dm}$ switching occurs between $V_{dm\text{-}clean}$ and $V_{dm\text{-}load}$ where $V_{dm\text{-}clean}$ is the voltage difference between the donor roll 46 and the magnetic brush roll 40 as the toner particles are attracted back to the magnetic roll 40 and off of the donor roll 46, and $V_{dm\text{-}load}$ is the voltage difference between the donor roll 46 and the magnetic brush roll 40 as the toner particles are attracted back to the magnetic roll 40 and off of the donor roll 46. Note that in this diagram the $V_{donor}$ voltage (donor roll voltage) is held constant when $V_{dm}$ is changed. The positive/negative polarities of FIG. 2 depend on all of the other voltages in the system (e.g. the toner polarity, photoreceptor polarity and bias voltage polarity). It can be either way. In order to choose an example embodiment, it is necessary that all of the polarities be specified. The preferred embodiment of the present invention, in a ROS (raster output scanner) based printer, would be a negatively charged photoreceptor, negatively charged toner and a negative donor bias. Then, the $V_{dm\text{-}load}$ would be positive (i.e. the switch would be in the left position) and the $V_{dm\text{-}clean}$ would be negative (i.e. the switch would be in the right position). The switch movement direction is shown by arrow 18. For ROS based printers DAD (Discharged Area Development) is the preferred mode of operation used to determine toner polarities, although CAD (Charge Area Development) may also be used. However, CAD must usually be used for light lens copiers and a light lens copier would require different charging for the preferred embodiment. (I.e. The photoreceptor would be negatively charged, the toner positively charged, the donor bias negatively charged, $V_{dm\text{-}load}$ negative and $V_{dm\text{-}clean}$ positive.)

With continued reference to FIG. 2, an alternate embodiment would be to switch the electrical arrangement the other way and keep the magnetic roll voltage ($V_{mag}$) constant while switching $V_{dm}$. These are different electrophotographically. The switching of the magnetic roll has the advantage that just after the voltage is switched from load ($V_{dm\text{-}load}$) to clean ($V_{dm\text{-}clean}$) there is no development bias change in the donor photoconductor nip. This is important because there is still toner on the donor roll in the photoconductor nip until the donor roll can rotate the distance between the magnetic brush loading nip and the photoconductor nip. However, under certain conditions one should also be able to utilize a system with a switched donor bias. Also it should be noted that a "switch" arrangement is shown whereas in an actual system there could be a single programmable bipolar power supply of some kind and the voltage would be controlled through digital or analog means. Furthermore, the preferred embodiment is to apply a large enough $V_{dm\text{-}clean}$ voltage to completely strip the toner from the donor roll. There might be situations where one could apply a $V_{dm\text{-}clean}$ voltage which was not the opposite polarity as $V_{dm\text{-}load}$, but simply a lower magnitude and/or polarity of $V_{dm\text{-}load}$. This would serve to strip some but not necessarily all of the toner off the donor roll. There would be cases where this partial stripping will accomplish the same goals as full stripping but enable a faster loading step. In the preferred embodiment the $V_{dm\text{-}clean}$ voltage would be applied upon completion of any desired image development from the developer housing and before housing and machine electrical and mechanical shutdown. The $V_{dm\text{-}load}$ voltage would be applied to reload toner on the donor roll prior to any additional development runs. Also there might be situations where one would apply a $V_{dm\text{-}clean}$ voltage for only a short period of time in the interdocument zone between copies of a multiple copy run. Also, in such an interdocument zone one might not attempt to fully strip the toner from the donor roll but simply to replace some of the toner with fresh toner. During long print runs, a large interdocument zone might be created artificially by intentionally skipping a print cycle or pitch to allow one thorough stripping and reload of toner on the donor roll.

In recapitulation, it is evident that the proper and stable charging of the donor roll of the present invention involves changing the magnitude and/or polarity of the differential electrical bias being applied between the donor roll and a second roll that supplies toner to the donor roll (i.e. a magnetic roll). (The image developing by the printing machine is stopped before this change in magnitude and/or polarity occurs.) The toner is then removed from the donor roll. Next, the magnitude and/or polarity of the electrical bias being applied to the donor roll is changed again. Then, toner is applied to the donor roll and a new printing run of the printing machine is started and/or development of images with the desired magnitude and/or polarity.

It is, therefore, apparent that there has been provided in accordance with the present invention, a method and apparatus for properly charging the donor toner layer that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for developing a latent image with toner, comprising:

means for transporting toner adjacent to the latent image;

means for supplying toner to said transporting means, said supplying means advancing carrier and toner;

means for stopping development of images; and means for forming a voltage difference between said supplying means and said transporting means when the development of images is stopped, with the voltage difference being of a first magnitude to attract toner from the carrier of said supplying means to said transporting means and of a second magnitude, different from the first magnitude, to attract toner from said transporting means to the carrier of said supplying means to clean said transporting means.

2. The apparatus of claim 1, wherein said transporting means comprises a donor roll.

3. The apparatus of claim 2, wherein said supplying means comprises a magnetic roll.

4. The apparatus of claim 3, wherein said forming means comprises:

a first voltage source;

a second voltage source; and a switch adapted to connect said first voltage source with said donor roll and said magnetic roll to form the voltage difference of the first magnitude and to connect said second voltage source with said donor roll and said magnetic roll to form the voltage difference of the second magnitude.

5. The apparatus of claim 3, further comprising means for electrically biasing said donor roll.

6. The apparatus of claim 3, wherein said switch connects said first voltage source to said donor roll and said magnetic roll to attract toner from said magnetic roll to said donor roll to develop the latent image.

7. The apparatus of claim 3, wherein said switch connects said second voltage source to said donor roll and said magnetic roll to attract toner from said donor roll to said magnetic roll to remove toner from said donor roll.

8. The apparatus of claim 3, further comprising electrode means interposed between said donor roll and the latent image, said electrode means detaching toner from said donor roll with the detached toner developing the latent image.

9. The apparatus of claim 1, wherein said first magnitude comprises a first polarity.

10. The apparatus of claim 1, wherein said second magnitude comprises a second polarity.

11. The apparatus of claim 1, further comprising means for starting development of the images.

* * * * *